US005730695A

United States Patent [19]

Hauschild et al.

[11] Patent Number: 5,730,695

[45] Date of Patent: Mar. 24, 1998

[54] METHOD AND APPARATUS FOR STACKING FOLDED TOWELS AND THE LIKE

[75] Inventors: Gilbert Hauschild; Rolf Majewski, both of Neuwied, Germany

[73] Assignee: Winkler & Duennebier Maschinenfabrik und Eissengiesserei KG, Neuwied, Germany

[21] Appl. No.: 485,102

[22] Filed: Jun. 7, 1995

[30] Foreign Application Priority Data

Jun. 8, 1994 [DE] Germany ..... 44 19 989.9

[51] Int. Cl.[6] ..... B65H 45/20

[52] U.S. Cl. ..... 493/416; 493/357; 493/450; 493/410; 270/39.02; 270/39.05

[58] Field of Search ..... 493/345, 346, 493/357, 372, 400, 405, 406, 409–412, 416, 417, 429, 430, 450; 270/21.1, 32, 39.01, 39.02, 39.05, 39.06, 40, 41, 42, 58.09, 58.28

[56] References Cited

U.S. PATENT DOCUMENTS

| | | | |
|---|---|---|---|
| 4,053,150 | 10/1977 | Lane | 493/417 |
| 4,721,295 | 1/1988 | Hathaway | 493/357 |
| 4,770,402 | 9/1988 | Couturier . | |
| 4,778,165 | 10/1988 | Buck | 493/412 |
| 4,824,426 | 4/1989 | DuFresne | 493/346 |
| 4,874,158 | 10/1989 | Retzloff | 493/410 |
| 5,088,707 | 2/1992 | Stemmler | 270/32 |
| 5,094,437 | 3/1992 | Hauschild | 270/39.09 |
| 5,147,273 | 9/1992 | Rottman et al. | 270/39.06 |
| 5,299,793 | 4/1994 | Couturier | 493/409 |
| 5,300,007 | 4/1994 | Kober | 493/450 |

FOREIGN PATENT DOCUMENTS

| | | |
|---|---|---|
| 0586802 | 3/1994 | European Pat. Off. . |
| 1278450 | 9/1968 | Germany . |
| 1957337 | 6/1970 | Germany . |
| 3927422 | 2/1991 | Germany . |

*Primary Examiner*—Joseph J. Hail, III
*Assistant Examiner*—Darren Ark
*Attorney, Agent, or Firm*—W. G. Fasse; W. F. Fasse

[57] ABSTRACT

An apparatus for stacking zig-zag interfolded articles such as towels (3) includes two carrier forks (22, 23) extending toward each other from opposite sides and forming a two-piece stacking table (8) onto which the folded towels are stacked. The apparatus further includes a pair of separating and auxiliary carrying forks (11, 12) that reach into the forming stack from opposite sides. In a method of stacking interfolded towels, the towels are stacked on the two piece stacking table (8) so that the folded edge of consecutive towels alternately faces to the right and to the left. The carrier forks (22, 23) of the two-part stacking table (8) reach under and support the bottom of the stack (2) from opposite sides and lower the stack onto a conveyor belt (26). Meanwhile, the separating and carrying forks (11, 12) reach under and support the bottom of a new stack being formed, from opposite sides.

16 Claims, 7 Drawing Sheets

METHOD AND APPARATUS FOR STACKING FOLDED TOWELS AND THE LIKE

FIELD OF THE INVENTION

The invention relates to a method and an apparatus for stacking folded articles such as paper towels, napkins, facial tissues or the like (generally referred to as towels herein) that are interfolded in a zig-zag fashion on top of one another. The towels arrive as a continuous web or single cut sheets that are folded and deposited, preferably with their respective folded edges facing alternately to the right and to the left, onto a lowerable support arrangement serving as a stacking table, while using a separating and auxiliary supporting mechanism for the stacked towels.

DESCRIPTION OF THE RELATED ART

An apparatus within the present field is described by U.S. Pat. No. 4,770,402 (Couturier) issued Sep. 13, 1988. The apparatus of Couturier includes two folding rolls arranged in parallel to each other, stripper or packer fingers, and a single lowerable stacking table or interfolding table, on which the folded articles are stacked, arranged below the folding rolls. When the stack has grown to the desired stack height, separator or count fingers are placed on top of the stack to separate the first stack and simultaneously serve as a carrier for the subsequent continuously deposited folded articles to form the next stack. To transfer the stack from the stacking table onto a different carrier, a pusher member or ejector pushes the stack laterally off the table, i.e. the ejector moves perpendicularly to the stroke direction of the stack. Furthermore, the stack is formed within a shaft or chute that laterally supports the stack when the separating and carrying fingers are laterally pulled out from under the stack when the new, partially formed stack is transferred onto the stacking table.

Problems arise in the operation of the known apparatus of Couturier, especially at the highest possible operating speed and when the towels to be stacked are made of extremely thin and/or extremely soft material, such as paper or fine tissue, as is the case for wiping towels, handkerchiefs, facial tissues, and the like, for example.

OBJECTS OF THE INVENTION

In view of the above it is the aim of the invention to achieve the following objects singly or in combination:

to provide an apparatus and a method within the general field described above, which are able to exactly deposit such folded towels at a high speed and with a high accuracy, even when the towels are made of a material that is difficult to handle because it is instable or fragile, for example because it is very thin and/or soft;

to improve the centering and the orienting support of a stack in such a method and apparatus, and to facilitate the transfer of a stack from carrier members to a further transport member so that the proper stacked arrangement of the folded towels is maintained and not disrupted;

to provide such a method and apparatus, in which a stack of the folded towels is carried on support members reaching beneath the stack from two opposite sides, so that the stack is only partially supported from underneath and is not supported over its entire bottom surface; and to form the stacking table in such a method and apparatus from two separate carrier members that can be moved independently and even in exact opposite directions, to reach under the stack or be pulled away from the stack in opposite directions, with a reduced lateral shifting tendency of the stack.

SUMMARY OF THE INVENTION

The above objects have been achieved in a method and apparatus according to the present invention, wherein the stack is supported or carried over a sufficient width of its bottom surface, while it is being formed and while it is being lowered. The stack is carried by carrier members that reach under the stack from opposite sides of the stack. Preferably, the carrier members only partially reach under the stack from two sides, and primarily provide an off-center support for the bottom of the stack.

This manner of supporting or carrying the stack achieves an orienting effect and especially a centering effect on the stack. Such an orienting or centering effect stabilizes the individual towels as well as the stack as a whole. Moreover, the support surface of the lowerable stacking table comprises two independent surfaces, which each only reach under a portion of the stack from opposite sides. When the-stack is to be transferred to a further transporting element such as a conveyor, these two separate support surfaces are easier to remove or pull away from the stack than a prior art carrier member that supports substantially the entire bottom surface of the stack on one carrier surface. Thereby, the invention assures that the individual folded towels in the stack remain properly stacked and oriented even after the stack is transferred from the stacking table onto a receiving surface or onto a conveyor belt or the like.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
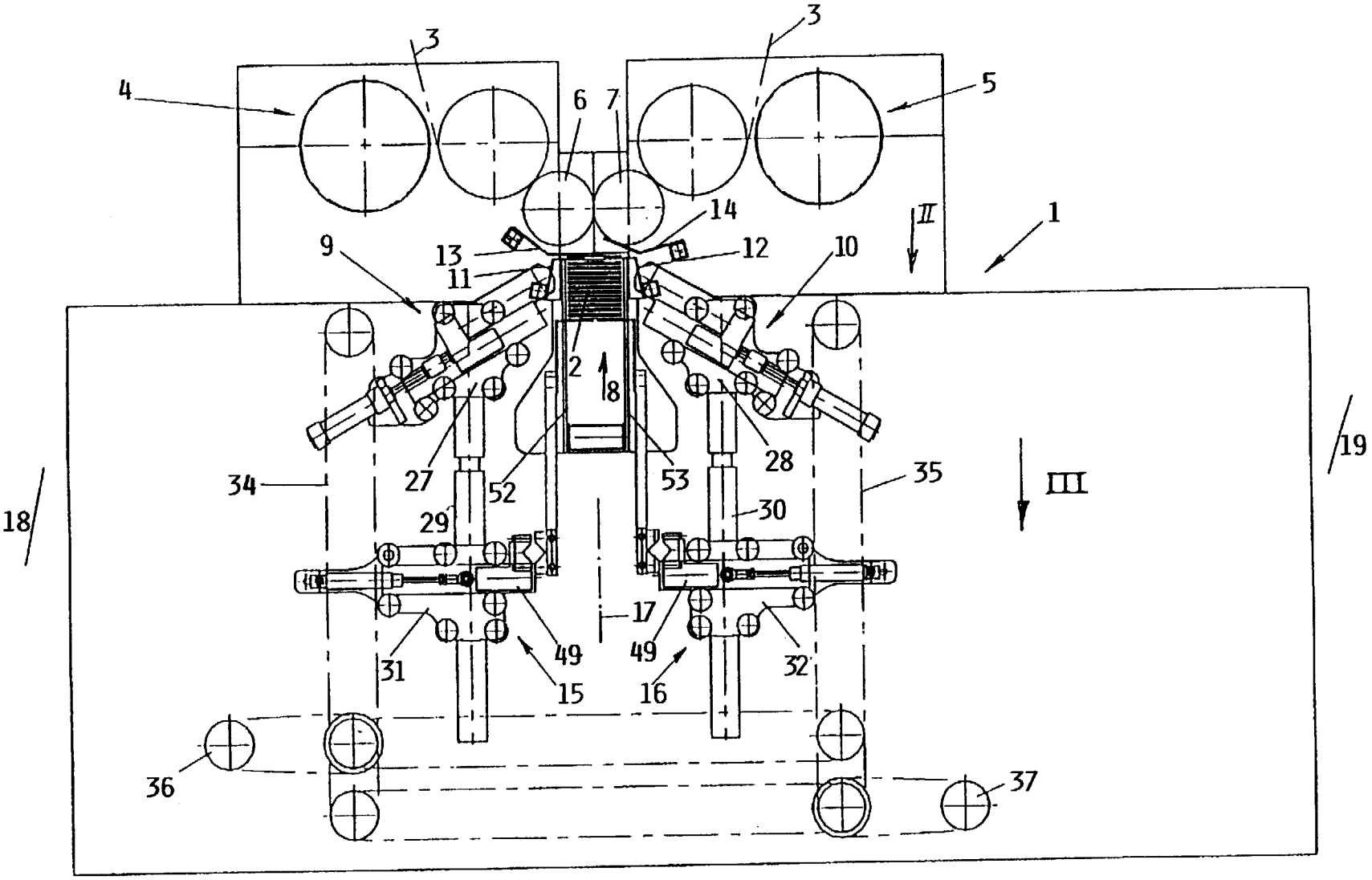
FIG. 1 is a schematic side view of an apparatus for folding and stacking zig-zag interfolded towels according to the invention.

As shown in FIG. 1, the present apparatus 1 for stacking zig-zag interfolded articles such as towels 3 in a stack 2 comprises two roller sets 4 and 5 for the towels 3 that are supplied as individual sheets or a continuous web. The apparatus 1 further includes two folding rollers 6 and 7 which fold and deposit the successive towels 3 on a stacking table 8 so that the consecutive towels 3 are interfolded and alternately arranged with their folded edge facing to the right and to the left. The stacking table 8 is formed by a lowerable stack support or carrier arrangement described in detail below. Throughout the present description, the term "interfolded towels" means that the successive towels are folded in an interleaved manner, so that at least one fold panel or web of each towel intermeshes with at least one fold panel or web of an adjacent towel.

Carrying out the stacking further involves the use of separating and auxiliary carrying mechanisms 9 and 10 which each comprise separating and carrying forks 11 and 12, and of stripping fingers 13 and 14 that cooperate with the folding cylinders 6 and 7. The typical operation of the stripping fingers 13 and 14, roller sets 4 and 5, and folding rollers 6 and 7 in forming the folds of the towels 3 and then depositing a stack 2 of the towels is generally known in the art.

According to the invention, the stack support or carrying arrangement serving as a stacking table 8 comprises two primary stack carrier mechanisms 15 and 16 arranged opposite one another, i.e. on opposite sides 18 and 19 of the stack 2 of towels 3. Basically, the two separating and auxiliary carrying mechanisms 9 and 10 and the two primary stack carrier mechanism 15 and 16 are arranged mirror-symmetrically about a central plane 17 extending vertically through the center of the stack 2. Thus, the several paired components work together from the two opposite sides 18 and 19 of the stack 2 for forming and lowering the stack, as shown especially in FIGS. 4 to 9 for example.

Figure 5:
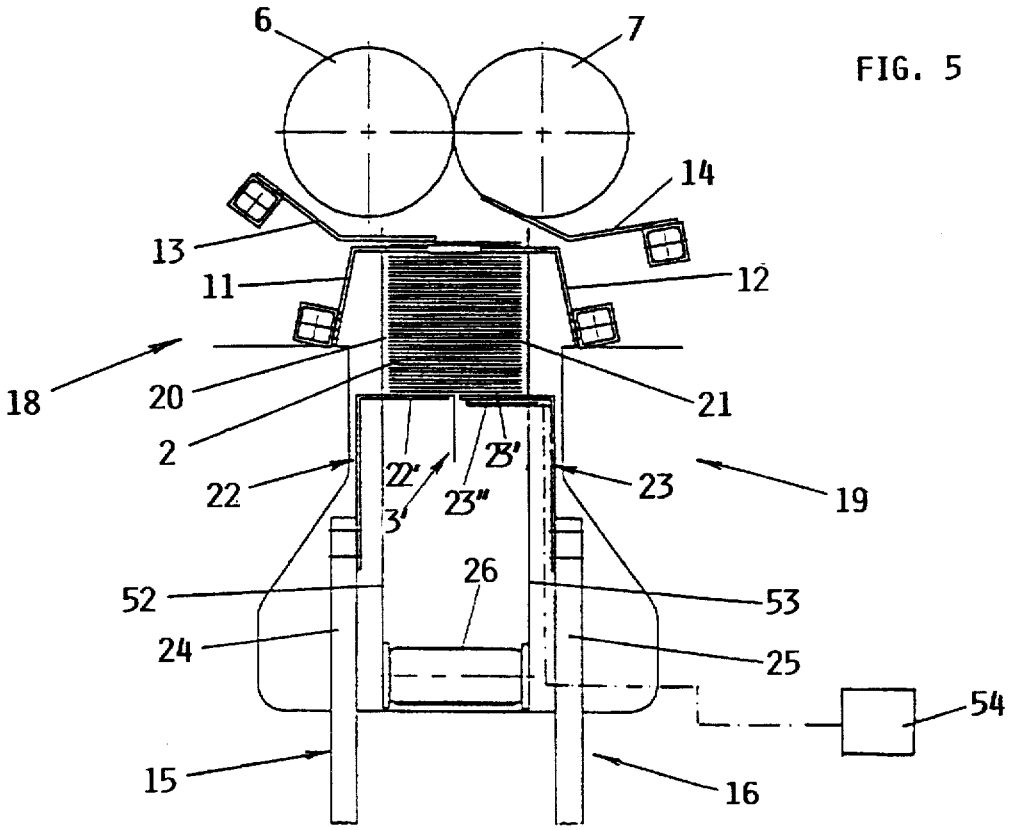
FIG. 5 is an enlarged detail view similar to that of FIG. 4, but showing the stage of separating a first completed stack.
Figure 6:
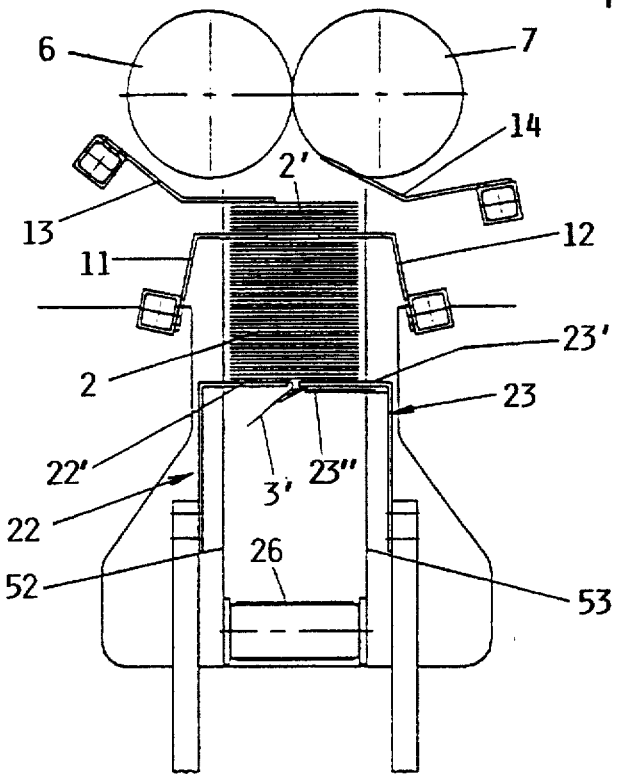
FIG. 6 is an enlarged detail view similar to that of FIG. 5, but showing the stage of forming the next stack.
Figure 7:
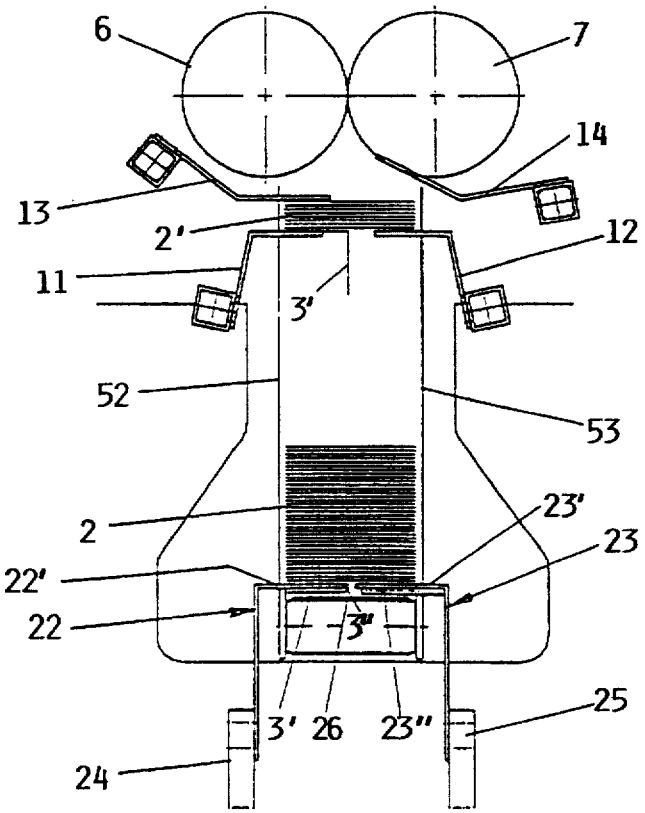
FIG. 7 is an enlarged detail view similar to that of FIG. 6, but showing the stage of the first stack having been lowered to be transferred onto a conveyor belt.

Referring especially to FIG. 5, it is evident that during the stack formation and stack depositing, the stack 2 of towels 3 is supported or carried from underneath especially at two opposite edge portions 20 and 21 located away from the centerline of the stack 2, but providing a sufficient supporting width for carrying the stack. The two edge portions 20 and 21 extend inwardly from the two outer edges of the bottom towel 3, from the two sides 18 and 19. This partial support of the stack at edge portions 20 and 21 pertains both to the completed stack 2 and to the stack 2' that is still being formed, as shown in FIGS. 6 and 7 for example. Similarly, the separation of the completed stack 2 from the next stack 2' being formed thereafter in a continuous stack formation process is also carried out from the two opposite sides 18 and 19.

The primary stack carrier mechanisms 15 and 16 comprise primary carrier forks 22 and 23 that directly support or carry the partial stack 2' in the process of being formed (FIG. 4), as well as the finished stack 2 (FIG. 5). The carrier forks 22 and 23 are arranged on support members 24 and 25 to be movable jointly in the stroke direction of the stack 2 and opposite one another in a direction perpendicular thereto, as respectively indicated by the double headed arrows A and B in FIG. 8. Thus, the stack carrier mechanisms 15 and 16 are able to transfer or deposit a finished stack 2 onto a moving conveyor belt 26 located directly below the stack 2, by pulling the carrier forks 22 and 23 respectively away from one another out of the position shown in FIG. 7 in the direction of arrow B in FIG. 8. In this manner, the carrier forks 22 and 23 are pulled out from under the stack in opposite directions, i.e. toward the opposite sides 18 and 19, so that the stack 2 is lowered onto the conveyor belt 26. Simultaneously, the bottom towel 3 is pulled taut and smooth as shown in FIG. 7.

In a similar manner as the two carrier forks 22 and 23 reach directly under edge portions of the stack 2 from opposite sides 18 and 19 to carry and lower the stack 2, the separating and auxiliary carrying forks 11 and 12 of the two separating and auxiliary carrying mechanisms 9 and 10 reach over the stack 2 from the two opposite sides 18 and 19. More specifically, once the stack 2 has reached the required stack height, the separating and carrying forks 11 and 12 are pushed laterally into the stack between two successively deposited towels 3 so as to form a separating element between the finished stack 2 and the new stack 2' being formed. Similarly as described above, the separating and carrying forks 11 and 12 only contact or rest on a portion of the top surface of the finished stack 2, namely reaching over only the edge portions 20 and 21 of the top towel 3 of the stack 2, as shown in FIGS. 1, 5 and 6, for example. Moreover, the separating and carrying forks 11 and 12 carry and support the new forming stack 2' primarily off-center from the two sides 18 and 19, or at the edge portions 20 and 21, as in the case of the carrier forks 22 and 23.

Figure 9:
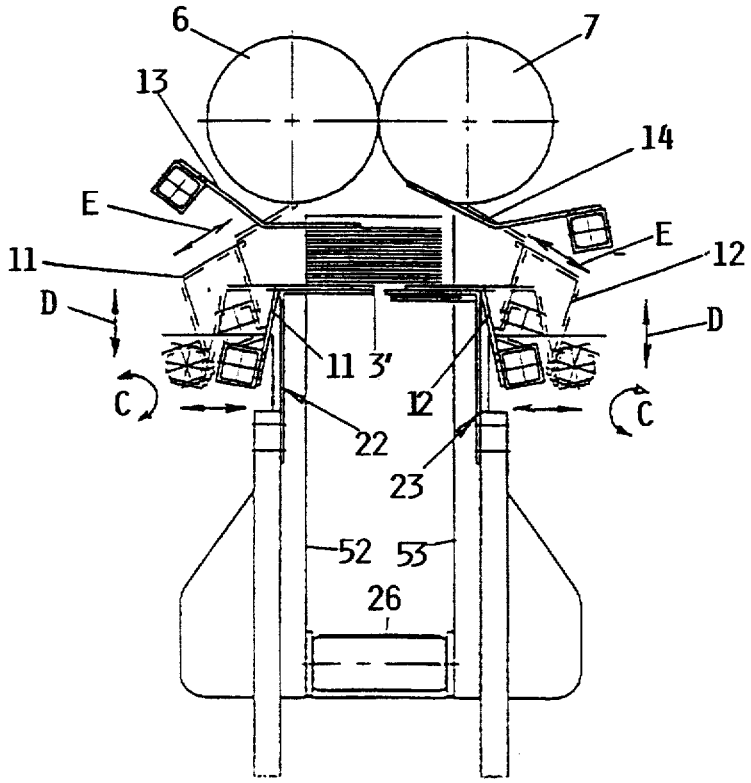
FIG. 9 is an enlarged detail view similar to that of FIG. 8 showing a further stage, with further directional arrows indicating the direction of motion of the components.

Furthermore, the separating and carrying forks 11 and 12 are tiltable, as well as slidable or movable in directions inclined at a non-perpendicular angle relative to the stroke direction of the stack carrier mechanisms 15 and 16, as indicated respectively by directional arrows C and E shown in FIG. 9, for example. To achieve this, the separating and carrying forks 11 and 12 are appropriately movably connected respectively to two support members 27 and 28, which in turn are movably arranged along respective guides 29 and 30. Thus, the support members 27 and 28 together with the separating and carrying forks 11 and 12 are movable in the stroke direction of the stack carrier mechanisms 15 and 16 as indicated by the directional arrows D in FIG. 9. The stack carrier mechanism 15 and 16 also comprise two support members 31 and 32 which are movable in the stroke direction along the same guides 29 and 30.

Figure 4:
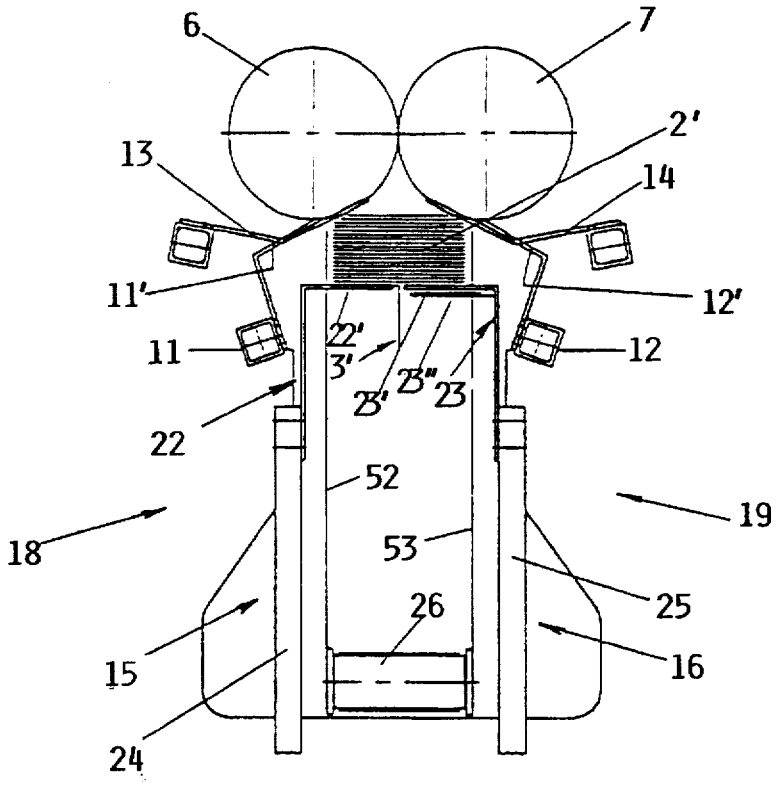
FIG. 4 is an enlarged detail view of a portion of FIG. 1, showing the state at the beginning of stack formation.
Figure 8:
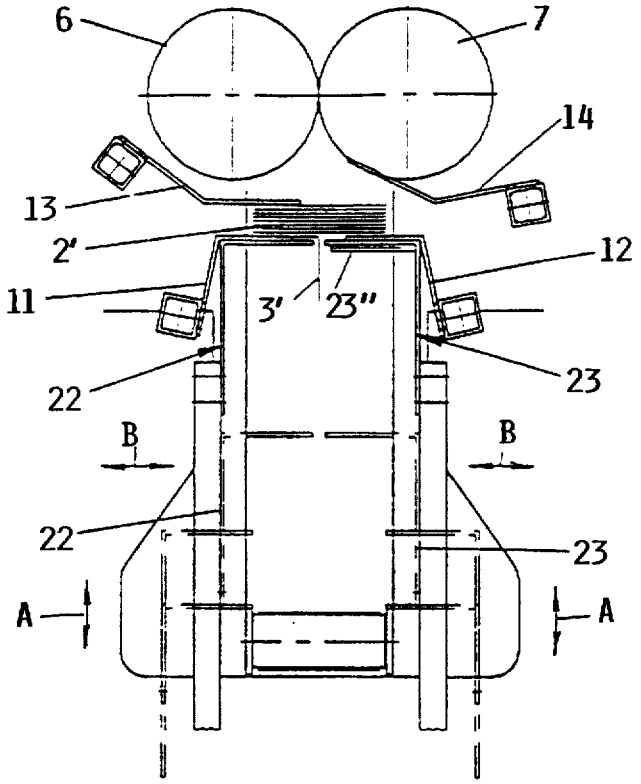
FIG. 8 is an enlarged detail view similar to that of FIG. 7, but showing the stage after the first stack has been carried away by the conveyor belt and the stacking table has again moved up, whereby directional arrows show the direction of motion of the components.

Referring especially to FIG. 4, the separating and carrying forks 11 and 12 respectively comprise fingers 11' and 12', and the carrier forks 22 and 23 respectively comprise fingers 22' and 23'. The fingers 11' and 12' are arranged shifted or offset from the fingers 22' and 23' in a direction perpendicular to the drawing plane of FIG. 4. The stripping fingers 13 and 14 are arranged shifted or offset from the fingers 11' and 12' and align with the fingers 22' and 23' in a direction perpendicular to the drawing plane of FIG. 4. In this manner, the fingers 11' and 12' of the separating and carrying forks 11 and 12 can reach between or intermesh with the stripping fingers 13 and 14 (FIG. 4) and also reach between the fingers 22' and 23' of the carrier forks 22 and 23 (FIG. 8). This arrangement guarantees friction-free and interference-free operation during transfer of the stack, whereby laterally arranged shaft or chute walls 52 and 53 also provide a stabilizing effect as shown in FIGS. 1 and 5. Appropriate slits or slots (not shown) are provided in the chute walls 52 and 53, through which the fingers 11', 12', 22' and 23' can reach.

Figure 2:
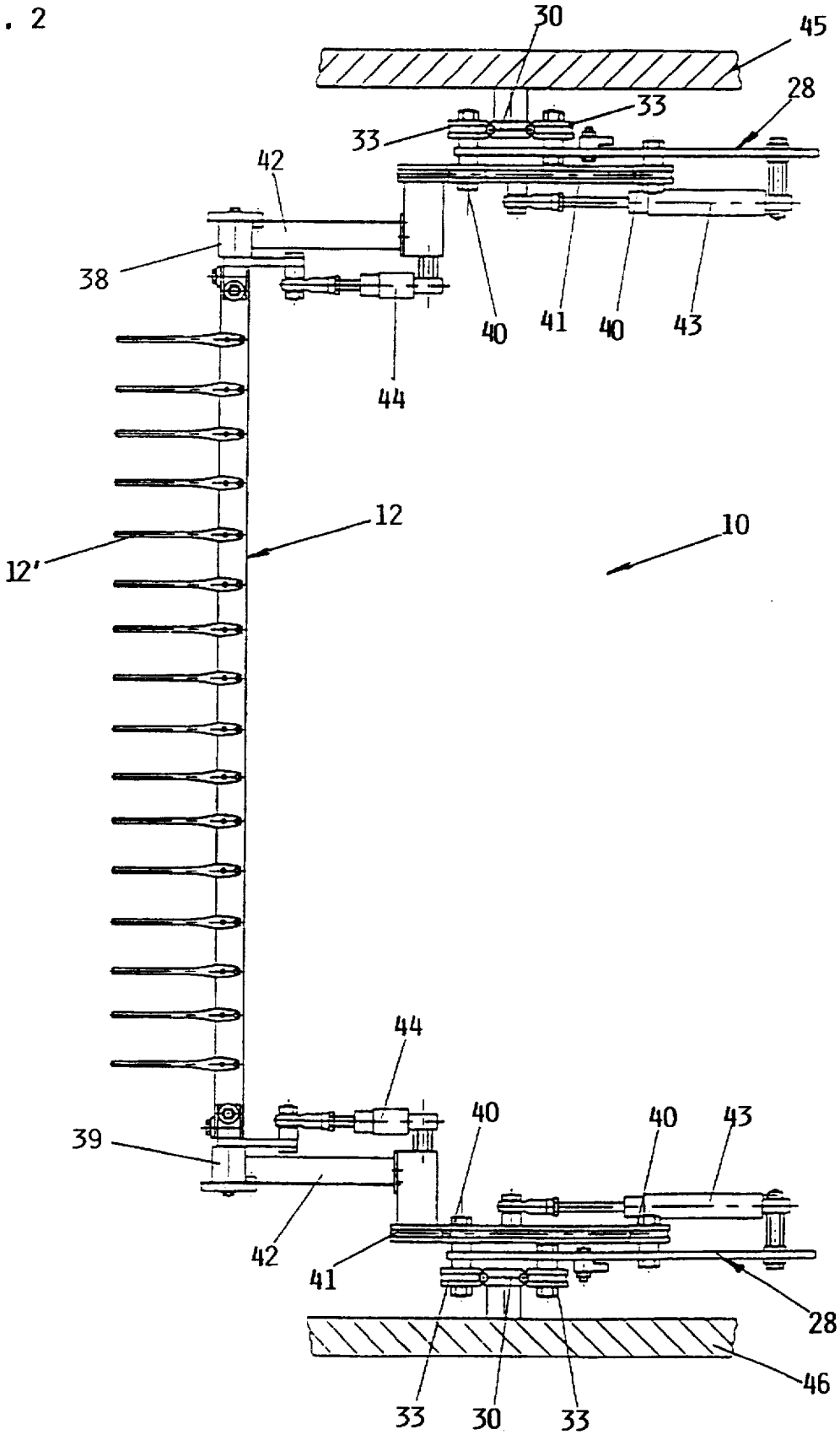
FIG. 2 is an enlarged detail view of a part of the apparatus of FIG. 1, taken in the direction of arrow II in FIG. 1, before beginning to deposit a stack of towels.
Figure 3:
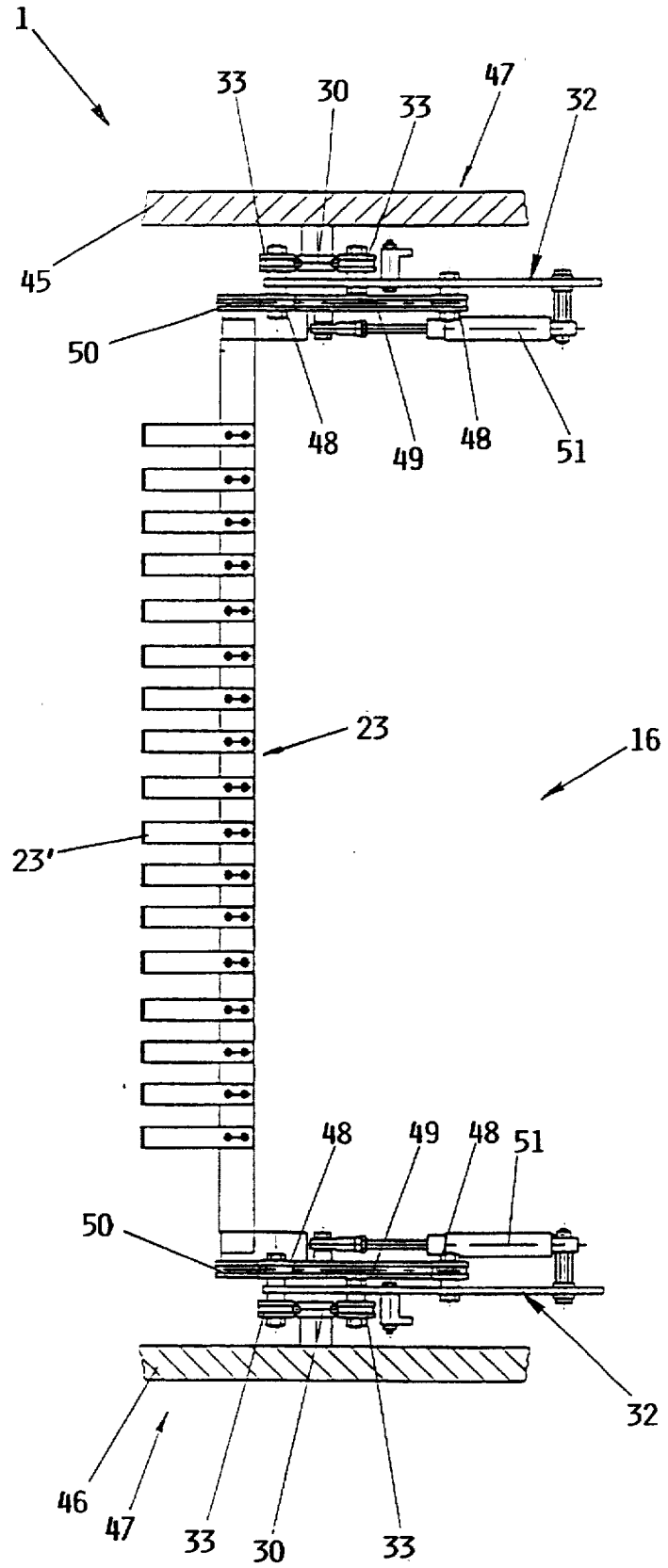
FIG. 3 is an enlarged detail view of a part of the apparatus of FIG. 1, taken in the direction of arrow III in FIG. 1, and wherein the stack carrier mechanism has been lowered.

As shown especially in FIGS. 2 and 3, the support members 27, 28, 31 and 32 that support and guide the various components as described above, comprise rollers 33 that roll along the guides 29 and 30 to movably support the support members 27, 28, 31 and 32. As shown especially in FIG. 1, the apparatus further includes drives 34 and 35, for example in the form of chain or belt drives, with associated electric motors 36 and 37, for driving the support members 27, 28, 31 and 32 along the guides 29 and 30.

As shown especially in FIG. 2, the separating and carrying fork 12 is supported at each of its two ends 38 and 39 on a respective support member 28, which in turn is movably supported along two guides 30. In the view of FIG. 1, the two guides 30 are arranged one behind another, so that only one guide 30 is visible. The other separating and carrying fork 11 has the same structure and arrangement as that of the fork 12 shown in FIG. 2, but is arranged mirror-symmetrically on the opposite side of the central plane 17, that is to say is effective from the opposite side 18 rather than the side 19.

Referring to the details of FIG. 2, in this example embodiment, a respective holder bracket 42 connects each of the ends 38 and 39 of the separating and carrying fork 12 to a guide element 41 that is guided and supported by support and guide rollers 40 provided on each support member 28. As is apparent from FIG. 1, the guide elements 41 extend in the above-mentioned directions inclined at a non-perpendicular angle relative to the main stroke direction. Respective pneumatic drives 43, for example pneumatic piston cylinder devices connected to the guide elements 41, slidingly move the guide elements 41 to correspondingly move the separating and carrying fork 12 in the above-mentioned inclined directions. Furthermore, the two ends 38 and 39 of the separating and carrying fork 12 are tiltably or rotatably supported on the holder bracket 42, and further drive elements 44, such as pneumatic piston cylinder devices are connected to the fork 12 so as to tilt or rotate the fork 12 about a lengthwise axis.

Components basically similar to those described above are used in connection with the carrier forks 22 and 23 and the associated stack carrier mechanisms 15 and 16. FIG. 3 shows two groups of components of the stack carrier mechanism 16 arranged to support the respective ends of the carrier fork 23. In the view of FIG. 1, the components at the two ends of the fork 23 are shown one in front of the other, so that only one set of the components is visible. Similarly to the case of the separating and auxiliary carrying mechanism 10 shown in FIG. 2, the individual components of the stack carrier mechanism 16 shown in FIG. 3 are also arranged mirror-symmetrically relative to one another. Furthermore, the stack carrier mechanism 15 has the same arrangement as that of the stack carrier mechanism 16 shown in FIG. 3, but is simply arranged in a mirror-symmetrical fashion on the opposite side of the central plane 17.

Rollers 33 are provided on the respective support members 32 of the stack carrier mechanism 16, whereby each support member 32 is movable along the respective guide 30 by means of the rollers 33. As shown especially in FIG. 3. The guides 30 are secured respectively to components 45 and 46 of the machine frame 47. Moreover, each support member 32 comprises support and guide rollers 48, which support and guide a guide element 49, having a free end 50, on which the respective ends of the carrier fork 23 are secured. Two drive elements 51, such as pneumatic drive elements, are respectively connected to and braced against the two support members 32, to slidingly move or displace the carrier fork 23.

FIG. 8 shows the motion of the two stripping fingers 13 and 14 during the folding and depositing process. FIG. 9 further shows details relating to the motion of the separating and carrying forks 11 and 12. The separating and carrying forks 11 and 12 are tiltable or rotatable as shown by the two circular double-headed arrows C, linearly movable in the stroke direction of the stack as shown by the two double-headed arrows D, and linearly movable at an angle, preferably a non-perpendicular angle, inclined relative to the stroke direction of the stack as shown by the two double-headed arrows E. Dashed lines show the separating and carrying forks 11 and 12 in various positions during an operating sequence.

Figure 10:
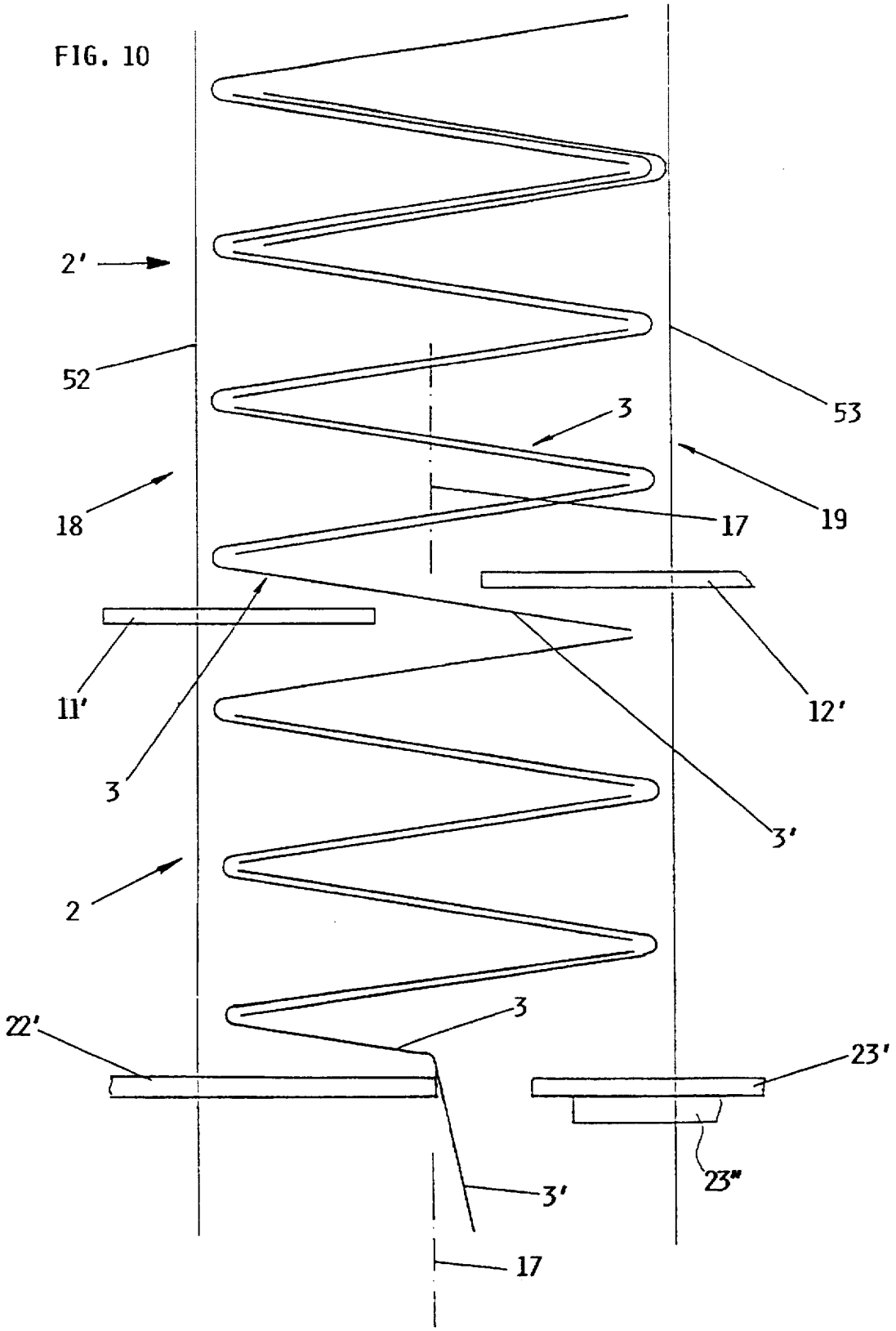
FIG. 10 is a detail view in a greatly enlarged scale schematically showing successive stacks of interfolded towels being formed, and the manner of operation of jointly functional separating and carrying forks.

FIG. 10 schematically shows the interfolded and stacked arrangement of the separate or individual towels 3 being stacked between the shaft or chute walls 52 and 53, while using fingers 11' and 12' of the two separating and carrying forks 11 and 12 and the fingers 22' and 23' of the two carrier forks 22 and 23 according to a preferred example embodiment of the invention. The view of FIG. 10 shows the respective fingers 11', 12', 22' and 23' reaching into the finished stack 2 and the new stack being formed 2' from the two opposite sides 18 and 19. The opposite fingers 11' and 12' are preferably vertically offset or displaced from one another by one ply of the towel 3, so that the opposite fingers 11' and 12' reach into the stack 2, 2' separated by a half of a towel 3. As a result of this offset, the edge portion 3' of the bottom or lowermost towel 3 in the forming stack 2' protrudes and hangs down from the free edge of the finger 11' of the separating and carrying fork 11 when the completed stack 2 is removed downwardly. Basically the same is true for the bottom towel 3 of the completed stack 2, namely, the edge portion 3' of the lowermost towel 3 of the completed stack 2 hangs downward from the finger 22' of the carrier fork 22 and below the finger 23' of the carrier fork 23 while the stack 2 is being lowered. Thus, the edge portion 3' crosses a central vertical stack plane extending vertically through the stack, as the edge portion 3' extends from a primary folded edge of the lowermost towel 3 at the outermost left side plane of the stack to the free edge of the towel 3 hanging down on the right side of the central vertical stack plane.

In order to ensure a controlled and properly arranged depositing of the finished stack 2 onto a further conveyor such as a conveyor belt 26, i.e. to ensure the proper disposition of the edge portion 3' of the bottom towel 3 of the stack 2, a fluid jet of a blowing medium such as an airstream is blown against the edge portion 3' shortly before the stack 2 is deposited on a receiving surface or on the conveyor belt 26. The air jet is directed at the edge portion 3' of the bottom towel 3 by air blowing nozzles 23" provided on the bottom of the fingers 23' of the carrier fork 23, facing toward the fingers 22', as shown especially in FIGS. 5 to 8 and 10.

Preferably, the air jets blow the edge portion 3' of the lowest towel 3 back around the finger 22' and flat against the bottom of the finger 22', as shown especially in FIGS. 6 and 7. As shown in FIG. 7, the folded-back portion of the edge portion 3' forms an additional folded edge 3" once the stack 2 is deposited onto the conveyor belt 26. After the stack is packaged and arranged in a dispenser, the additional folded edge 3" will form a convenient gripping edge by which a consumer can grip the bottom towel 3 of the stack 2 to pull the towel out of the dispenser.

Preferably, as the stack 2 is lowered and then deposited on a receiving surface or on the conveyor belt 26, the stack 2 is supported from one side 18 over more than half of its lower surface, i.e. the fingers 22' reach under the stack past its central plane 17, whereby the fingers 22' have a sufficient length to achieve the preferred support. More particularly, the fingers 22' may reach under the stack from the side 18 to support about one half or even slightly more than one half of the total bottom width of the stack, while the fingers 23' reach under the stack 2 from the opposite side 19 to support about one third of the total bottom width of the stack in the example shown in FIG. 10. While the completed stack 2 is being lowered onto the conveyor belt 26, the new stack 2' being formed is supported on the separating and carrying forks 11 and 12. As shown in FIG. 10, the fingers 11' reach under the newly forming stack 2' from one side 18 to support between about one third and about 45% of the total bottom width of the stack 2'. From the other side 19, the fingers 12' reach under the stack 2' to support from about one third to about 45% of the total bottom width of the stack 2'.

In summary, FIGS. 4 to 9 show successive stages in the operation of the apparatus and method according to the invention. In FIG. 4, the folding rollers 6 and 7 together with the stripping fingers 13 and 14 are forming a stack 2' on the fingers 22' and 23' of the carrier forks 22 and 23 respectively. The separating and carrying forks 11 and 12 are in a ready or waiting position clear of the stack 2' and not interfering with the stacking operation. As the stack height increases, the carrier forks 22 and 23 are moved downwardly as the stack grows. Once the stack has reached the desired stack height, as shown in FIG. 5, the separating and carrying forks 11 and 12 tilt or rotate into position to reach into the stacking path of the towels which are being continuously folded and stacked. Thus, as shown in FIG. 6, a new stack 2' is supported on the separating and carrying forks 11 and 12 and continues to grow thereon.

As shown in FIGS. 6 and 7, the edge portion 3' of the lowermost towel 3 in the completed stack 2 is folded back by the air jets from the air nozzles 23", and the carrier forks 22 and 23 are lowered to lower the stack 2 toward the conveyor belt 26. The carrier forks 22 and 23 are then pulled laterally out of the stack to deposit the stack onto the conveyor belt 26, as shown by dashed lines in FIG. 8. As further shown in FIGS. 8 and 9, the carrier forks 22 and 23 are then moved upward and laterally inward to again be in a position to support a stack of towels, whereupon the carrier forks 22 and 23 take over from the separating and carrying forks 11 and 12 the new stack 2' being formed thereon. To achieve this transfer, the fingers of the carrier forks 22 and 23 are intermeshed with or positioned between the fingers of the separating and carrying forks 11 and 12, which are then retracted laterally, tilted or rotated clear of the stack, and then moved diagonally back into the ready or starting position shown in FIG. 4.

It is also possible to form a gap in the deposited or stacked towels 3 before carrying out the zig-zag interfolding. It is generally known in the art how such gaps in the stack of folded towels can be formed, as described in German Patent Laying-Open Document 3,927,422 for example.

It should be understood that the present invention is not limited to the concrete example shown in the accompanying drawings and described above. Rather, the invention extends to cover many variations and modifications that would be understood within the scope of the invention. In the example embodiments shown in the figures and described above, each separating and carrying fork 11 and 12 is associated with two support members 27 or 28 as well as the other related components arranged on each support member. The same is true of the two carrier forks 22 and 23, which have two support members 31 or 32 associated therewith. As a result, the apparatus 1 described above respectively includes two support members 27, two support members 28, two support members 31 and two support members 32. However, such a construction is not absolutely necessary, because each of the separating and carrying forks 11 and 12 together with the remaining associated components could alternatively be arranged on one single support member.

Furthermore, it should be understood that various peripheral and auxiliary components are associated with the apparatus in operation, but are not shown or descried in detail herein. For example, an air blower or compressed air source 54 is connected to the air nozzles 23" in order to provide compressed air to the nozzles.

Although the invention has been described with reference to specific example embodiments, it will be appreciated that it is intended to cover all modifications and equivalents within the scope of the appended claims.

What is claimed is:

1. A method of stacking folded articles, comprising the following steps:

a supplying step comprising supplying and depositing successive ones of said folded articles to form a growing stack having an increasing height;

a supporting step comprising supporting two portions of a bottom of said stack on primary carrier members reaching under said stack from opposite sides of said stack, wherein said two portions of said stack bottom are spaced apart from one another with an unsupported portion of said stack bottom therebetween;

a lowering step comprising lowering said primary carrier members in correspondence with said increasing height of said growing stack;

a moving step comprising, when said increasing height of said growing stack reaches a desired completed stack height, moving respective auxiliary carrier members toward one another from said opposite sides of said stack at said desired completed stack height to define a completed stack between said auxiliary carrier members and said primary carrier members;

a continuing step comprising continuing said supplying and depositing of successive ones of said folded articles onto said auxiliary carrier members to form a new growing stack, while supporting two portions of a bottom of said new stack on said auxiliary carrier members, wherein said two portions of said new stack bottom are spaced apart from one another with an unsupported portion of said new stack bottom therebetween;

a transporting step comprising transporting away said completed stack; and a transferring step comprising transferring said new growing stack onto said primary carrier members and moving said auxiliary carrier members in opposite directions laterally away from said stack to said opposite sides of said stack;

wherein said folded articles are deposited and said auxiliary carrier members are positioned in such a manner that a free edge portion of a bottom one of said articles of said new growing stack extends freely downwardly between said auxiliary carrier members during said continuing step and then extends freely downwardly between said primary carrier members during said transferring step.

2. The method of claim 1, wherein said folded articles are supplied and deposited so as to be interfolded in a zig-zag fashion, wherein at least one fold web of each of said articles is interleaved and intermeshed with at least one fold web of an adjacent one of said articles, and wherein consecutive ones of said articles have alternating fold orientations in said stack.

3. The method of claim 1, wherein said free edge portion crosses a vertical stack plane extending vertically through the center of said stack, and wherein a primary folded edge of said bottom one of said articles is located at an outermost stack side plane on a first side of said vertical stack plane and said free edge portion extends freely downwardly on a second side of said vertical stack plane.

4. The method of claim 1, wherein said transporting step comprises lowering said primary carrier members and depositing said completed stack onto a conveyor belt, further comprising a step of blowing said free edge portion with a gas stream to deflect said free edge portion into an orientation more toward horizontal before said depositing of said completed stack onto said conveyor belt.

5. The method of claim 4, wherein a folded-back portion of said free edge portion is folded under a remainder of said free edge portion so as to form an additional folded edge between said folded-back portion and said remainder having a total 180° fold as a result of both said blowing of said free edge portion and said depositing of said completed stack onto said conveyor belt.

6. The method of claim 1, wherein said transporting step comprises lowering said primary carrier members and then depositing said completed stack onto a conveyor belt by laterally pulling said primary carrier members out from under and away from said completed stack toward said opposite sides of said stack.

7. The method of claim 1, wherein said moving step comprises moving said auxiliary carrier members toward each other in such a manner that said auxiliary carrier members are vertically offset from each other.

8. The method of claim 1, wherein said moving step comprises tilting said auxiliary carrier members about respective rotational axes toward said stack, and wherein said moving of said auxiliary carrier members away from said stack in said transferring step comprises linearly moving said auxiliary carrier members in respective opposite directions laterally away from said stack and then tilting said auxiliary carrier members respectively about said rotational axes away from said stack, and further comprising linearly moving said auxiliary carrier members upward and toward said stack along respective directions inclined at a non-perpendicular angle relative to a vertical stack plane passing through said stack.

9. An apparatus for stacking folded articles, comprising an article feed mechanism including a pair of feed rollers, an article folding mechanism including a pair of folding rollers, a pair of stripper fingers cooperating with said folding rollers to fold and stack said articles, first and second primary carrier members adapted to carry a stack of said articles, and first and second auxiliary carrier members respectively including separating and carrying forks for said folded articles arranged above said primary carrier members and adapted to separate a completed stack of said articles from a next stack being formed and to support said next stack, wherein said first and second primary carrier members are raisable and lowerable in common along a primary stroke direction and are adapted to respectively reach under said stack from first and second opposite sides of said stack so that a first space remains between said primary carrier members, and further comprising primary linear guides extending parallel to said primary stroke direction, diagonal linear guides extending in a diagonal direction at a non-perpendicular angle relative to said primary stroke direction, and first and second auxiliary drive mechanisms connected respectively to said first and second auxiliary carrier members to independently drive said first and second auxiliary carrier members upwardly and downwardly on said primary linear guides along said primary stroke direction and linearly on said diagonal linear guides along said diagonal direction extending at a non-perpendicular angle relative to said primary stroke direction and tiltably toward each other from said opposite sides of said stack so as to respectively reach into said stack from said opposite sides of said stack so that a second space remains between said auxiliary carrier members, and wherein said first space and said second space are respectively so dimensioned and positioned, and said primary carrier members and said auxiliary carrier members are respectively arranged such that a free edge portion of a bottom one of said folded articles in said completed stack extends freely downwardly through said first space and such that a free edge portion of a bottom one of said folded articles in said next stack extends freely downwardly through said second space.

10. The apparatus of claim 9, wherein said primary linear guides include first and second guides extending parallel to said primary stroke direction, and further comprising first and second support members arranged respectively on said first and second guides to be movable therealong, wherein each of said separating and carrying forks is mounted via a respective one of said diagonal linear quides on a corresponding one of said support members to be linearly slidable and rotationally tiltable thereon, and wherein said first and second primary carrier members are arranged to be laterally movable perpendicularly to said primary stroke direction to be adapted to move away from said stack.

11. The apparatus of claim 10, further comprising support and guide rollers mounted on said support members and adapted to move along said guides, and wherein said drive mechanisms include drive devices connected to said support members and said separating and carrying forks and adapted to drive said separating and carrying forks relative to said support members.

12. The apparatus of claim 9, wherein said primary linear guides include first and second guides extending parallel to said primary stroke direction, wherein said first and second primary carrier members respectively comprise first and second support members arranged to be movable respectively along said first and second guides, and first and second carrier forks for said folded articles movably connected respectively to said first and second support members to be movable perpendicularly to said primary stroke direction.

13. The apparatus of claim 12, further comprising support and guide rollers mounted on said support members and adapted to move along said first and second guides, and wherein said drive mechanisms include drive devices connected to said support members and said carrier forks and adapted to drive said carrier forks relative to said support members.

14. The apparatus of claim 9, wherein said first primary carrier member is adapted to reach further under said stack from said first side than said second primary carrier member does from said second side, and said first primary carrier member is adapted to reach under and support a bottom free end sheet portion of said bottom one of said folded articles in said completed stack, wherein said end sheet portion extends from a primary folded edge located at an outermost stack side plane of said bottom one of said folded articles in said completed stack.

15. The apparatus of claim 14, wherein said first primary carrier member is adapted to reach under more than half of a total width of said stack.

16. The apparatus of claim 9, further comprising blowing nozzles arranged on said second primary carrier member and adapted to direct a gas jet toward said first primary carrier member.

* * * * *

UNITED STATES PATENT AND TRADEMARK OFFICE

CERTIFICATE OF CORRECTION

PATENT NO. : 5,730,695

DATED : Mar. 24, 1998

INVENTOR(S) : Hauschild et al.

It is certified that error appears in the above-identified patent and that said Letters Patent is hereby corrected as shown below:

On the title page, in [56] References Cited U. S. PATENT DOCUMENTS
please add: --4,388,072 6/1983 Mueller et al.--.

Col. 5, line 47, after "rollers" replace "33. As" by --33 as--.

Signed and Sealed this

Ninth Day of June, 1998

*Attest:*

*Attesting Officer*

BRUCE LEHMAN

*Commissioner of Patents and Trademarks*